United States Patent [19]

Emmenegger

[11] Patent Number: 4,687,557

[45] Date of Patent: Aug. 18, 1987

[54] GOLD ALLOYS AND GALVANIC BATH FOR THE ELECTROLYTIC DEPOSIT THEREOF

[76] Inventor: Heinz Emmenegger, 22, Chapeau-Râblé , 2300 - La Chaux-de-Fonds, Switzerland

[21] Appl. No.: 832,087

[22] Filed: Feb. 24, 1986

[30] Foreign Application Priority Data

Mar. 1, 1985 [CH] Switzerland ..... 00944/85

[51] Int. Cl.[4] ..... C25D 3/58; C25D 3/62

[52] U.S. Cl. ..... 204/44; 204/44.3

[58] Field of Search ..... 204/44

[56] References Cited

U.S. PATENT DOCUMENTS

| | | | |
|---|---|---|---|
| 4,179,344 | 12/1979 | Thomson | 204/44 |
| 4,358,351 | 11/1982 | Simon et al. | 204/44 |
| 4,486,275 | 12/1984 | Emmenegger | 204/44 |

FOREIGN PATENT DOCUMENTS

| | | | |
|---|---|---|---|
| 353071 | 10/1979 | Austria | 204/44 |
| 0140832 | 5/1985 | European Pat. Off. | 204/44 |
| 1572525 | 6/1969 | France | 204/44.3 |
| 403435 | 6/1966 | Switzerland | 204/44 |
| 418085 | 2/1967 | Switzerland | 204/44 |
| 522740 | 6/1972 | Switzerland | 204/44 |
| 540344 | 9/1973 | Switzerland | 204/44 |
| 542934 | 11/1973 | Switzerland | 204/44 |
| 556916 | 12/1974 | Switzerland | 204/44 |
| 558836 | 2/1975 | Switzerland | 204/44 |
| 590344 | 8/1977 | Switzerland | 204/44 |
| 621367 | 1/1981 | Switzerland | 204/44 |
| 632533 | 10/1982 | Switzerland | 204/44 |
| 2012306 | 7/1979 | United Kingdom | 204/55 R |

*Primary Examiner*—T. Tung

*Attorney, Agent, or Firm*—Young & Thompson

[57] ABSTRACT

A galvanic bath for the electrolytic deposit of gold-based alloys contains a cyanide complex of gold, a cyanide complex of copper, a cyanide complex of cadmium and a cyanide complex of zinc, and at least one complexing agent and one surface-active agent, as well as, if desired, a depolarizing agent and/or an inorganic or organic brightening agent. This bath functions in the presence or in the absence of free cyanide.

16 Claims, No Drawings

GOLD ALLOYS AND GALVANIC BATH FOR THE ELECTROLYTIC DEPOSIT THEREOF

The present invention relates to new gold alloys, as well as galvanic baths for the electrolytic deposit of these alloys.

It is well known, in the field of plating of decorative articles, to use ternary Au-Cu-Cd alloys having a color from pale yellow to pink. Electrolytic baths for the deposit of such alloys have been the object of numerous patents, among which may be noted the Swiss PAT. Nos. 403,435, 418,085, 522,740, 540,344, 542,934, 556,916, 558,836, 590,344, 621,367 and 632,533.

All the baths described in these documents have the inconvenience of being relatively difficult to use, as they require a very strict control of the proportions of each constituent and generally of the set of parameters of the deposit; the concentration of the respective constituents is determined particularly so as to permit obtaining a deposit of alloys having the required quantities of surface, color, brilliance, and corrosion-resistance.

On the other hand, it has been verified that the presence of a fourth metal, more particularly zinc, permits working with greater variation of concentration, thereby providing an easier method for the skilled artisan. It was found, moreover, that these variations of concentration may be still larger and easier to maintain if one operates not only with metallic cyanide complexes, but also in the presence of free cyanide. This signifies that, at the time of preparing the bath, a quantity of alkaline cyanide calculated to form cyanide complexes with the different metals is added, and that it is also possible to add an excess of alkaline cyanide.

Thus, the object of this invention, seeking to overcome the above-described disadvantages of the known alloys and baths, resides in an alloy containing between 40 and 92% by weight gold, 4 to 12% by weight cadmium and from 0.1 to 1% by weight zinc, the rest being constituted by copper.

Moreover, another object of this invention resides in a galvanic bath for the electrolytic deposit of these Au-Cu-Cd-Zn alloys, which is characterized by the fact that it contains a cyanide complex of gold, a cyanide complex of copper, a cyanide complex of cadmium and a cyanide complex of zinc, and at least one complexing agent and one surface-active agent. The bath functions in the presence or in the absence of free cyanide.

In the baths for deposition of ternary gold-copper-cadmium alloys, which are the most widely used at present, the deposition of the gold is relatively independent of the concentration of free cyanide. On the other hand, this concentration greatly influences the potential for deposition of the copper, such that it is necessary to maintain it within relatively strict limits so as to permit the gold-copper codeposition. With respect to cadmium, in the form of a cyanide complex, it does not influence the cyanide complexes of gold and copper; it may therefore be concluded that its deposition is independent of the concentrations of copper metal and free cyanide. Thus, for 4 g/l of gold and 60 g/l of copper, which corresponds to the best conditions, the concentration of free potassium cyanide must be comprised between 22 and 32 g/l, or else the deposit becomes cloudy and pitted. If its free cyanide concentration is increased, the deposition of copper is halted and the deposit becomes too white. If this concentration is decreased, the deposit becomes too pink and too little resistant to corrosion.

As has been found, the copper-cyanide ratio is very important, for if the copper concentration decreases by half, say 30 g/l, the free cyanide concentration must also decrease by half; in this case, the working margin will therefore also be found reduced. That is why, in the conventional baths, it is preferable to work with very high copper concentrations, on the order of 60 to 70 g/l. This permits having a greater tolerance to the free cyanide concentration.

With the addition of zinc, the conditions of electrolytic deposition change totally. It is a question not only of the simple addition of a fourth metal in a bath, but of the creation of new baths, in which it is necessary to use different parameters than those which governed the deposition of a ternary alloy described above.

In effect, at the time of the addition of this fourth metal, to be known as zinc, it is no longer necessary to take account of the free cyanide-copper ratio, but rather it is the total cyanide-zinc ratio which becomes determining. As may be verified, by augmenting the quantity of zinc, the total quantity of cyanide must be augmented proportionally. For example, in the case of a quaternary bath containing zinc, there must be four times more total cyanide than zinc. The quantity of free cyanide may vary in a range from 0 to 30 g/l for 10 g/l of zinc. The more the zinc content increases, the greater this range will be.

The copper concentration must be reduced and may be between 5 and 70 g/l, whereas the concentration of zinc may vary from 0.5 to 50 g/l. With, for example, 35 g/l of copper and 5 g/l of zinc, one has in fact 20 g/l of cyanide not very firmly bound to the zinc complex. If one adds again 5 g/l of free cyanide, there are 25 g/l total cyanide in all. This permits obtaining excellent deposits. But if one is operating in other conditions, always with 35 g/l of copper and 10 g/l of zinc, there is obtained 40 g/l of bound cyanide; if one adds another 5 g/l of free cyanide, which increases the total cyanide to 45 g/l, there is similarly obtained deposits having excellent qualities with respect to their surface and corrosion resistance. This demonstrates that the relations between the concentrations of metals and total cyanide may be varied more widely than is the case with known ternary alloy baths.

The gold and the copper are introduced in the bath in the form of cyanide complexes $KAu(CN)_2$ and $K_2Cu(CN)_3$. The cadmium and the zinc may similarly be introduced in the form of cyanide complexes.

The baths which form the object of the present invention may contain, for example:

from 0.5 to 20 g/l of gold in the form of cyanide complex;

5 to 70 g/l of copper in the form of cyanide complex;

from 0.1 to 5 g/l of cadmium in the form of cyanide complex;

from 0.5 to 50 g/l of zinc in the form of cyanide complex;

from 0 to 30 g/l of free potassium cyanide;

from 1 to 200 g/l of total cyanide;

from 5 to 200 g/l of organic complexing agent;

from 0.01 to 50 ml/l wetting agent;

as well as, if desired:

from 0.01 to 100 mg/l of inorganic brighteners in the form of soluble salts or complexes of selenium, tellurium, vanadium, arsenic, antimony, thallium, bismuth, titanium, germanium, zirconium, tantalum and/or niobium;

from 1 to 5 ml/l of organic brighteners in the form of 50% solutions of the condensation products of nicotinic acid and benzyl chloride and/or a benzyl-pyridine-carboxylate of an alkaline metal, and/or a piperonyl bisulfite or an anisaldehyde bisulfite;

from 2 to 200 mg/l of sodium thiosulfate or derivatives of thiocarboxylic or thioalkane sulfonic acids, for example mercaptosuccinic acid, acting as depolarizing agents.

As complexing agents, one may use singly or in combination commercially available products, which are for example amino carboxylics, hydroxy-alkyl-amino-carboxylics, poly-amino-carboxylics, hydroxy-alkyl-poly-amino-carboxylics, aminophosphonics, polyaminophosphonics, phosphonic acids or also aminocarboxylic-phosphonic acids, which belong to different classes of chemical compounds, but the molecule of which always contains one or several nitrogen atoms connected to the various groups, such as those of methyl phosphonic acids or also alkyl, carboxylic alkyl and hydroxy alkyl.

Methyl phosphonic acids, the molecule of which contains one or several nitrogen atoms, which may be used, for example, are the acids:

amino-tris-(methylene-phosphonic);

1-hydroxy-ethylidene-1, 1-diphosphonic;

ethylene-diamine-tetra-(methylene-phosphonic);

hexamethylene-diamine-tetra-(methylene-phosphonic).

Among the compounds, the molecule of which comprises, in addition to one or several nitrogen atoms, alkyl, carboxyalkyl or hydroxy alkyl groups, are particularly the chemical compounds of the general formula

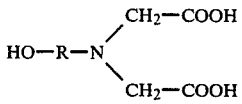

where R is alkylene group of which the number of carbon atoms is between 1 and 4, or also nitrilo-triacetic acid (NTA), oxycarbonylethylaminodiacetic acid, N-carboxymethyl aspartic acid, N-N-bis-(carboxymethyl)-aspartic acid, aspartic acid, glutamic acid, and iminodiacetic acid, etc. All these acids are preferably used in the form of soluble salts, that is to say in the form of sodium, potassium, ammonium or amine salts.

As surface-active agents, there may be used singly or in combination commercially available products, known by the designations of non-ionic, anionic, cationic, or amphoteric surface-active agents. In particular, there may advantageously be used amidopropyldimethylamino oxides of saturated aliphatic acids, of the general formula:

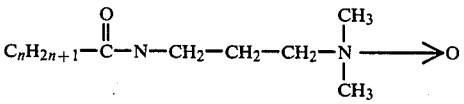

dimethylamino oxides of saturated aliphatic acids, of the general formula:

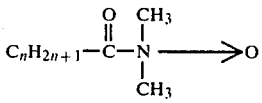

dimethylalkyl amino oxides, of the general formula:

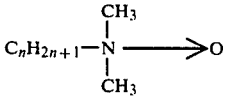

and bis-(2 hydroxyethyl)-alkylamino oxides, of the general formula:

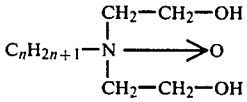

where n is a number between 11 and 20. The aliphatic or alkyl acid groups may similarly be ethoxylated.

There may also be used as surface-active agents phosphorated esters with ethylene oxide chains connected to an aliphatic chain, of the general formula

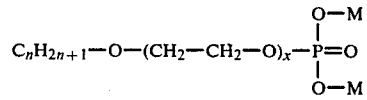

monoester, or

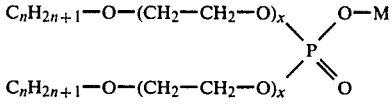

diester.

In these formulas, n is a number between 8 and 18, x a number between 6 and 15 and M a sodium or potassium ion.

The concentrations of the various organic addition products may vary in a relatively wide range, say from 5 to 200 g/l for the complexing agents and from 0.01 to 50 ml/l form the surface-active agents.

The term inorganic brighteners is intended to mean soluble salts, thus alkaline metals, ammonium or amine, or also complex salts of certain elements, capable of influencing the crystallization of the galvanic deposit such that it appears brilliant. These inorganic brighteners contain the elements selenium, tellurium, vanadium, arsenic, antimony, thallium, bismuth, titanium, germanium, zirconium, tantalum and/or niobium. These inorganic brighteners are used at low concentrations, say from 0.01 to 100 mg/l.

The presence of certain organic products similarly permits the obtention of brilliant deposits of gold-copper-cadmium-zinc alloy. There may advantageously be used the condensation product of nicotinic acid and benzyl chloride, as well as a benzyl-pyridine-carboxylate and a piperonyl bisulfite and/or an anisaldehyde bisulfite. These organic brighteners may be used alone or in mixture, or also in the presence of inorganic brighteners. They are added in the form of aqueous solutions at 50% concentration on the order of 1 to 5 ml/l.

To augment the conductivity of the bath between the electrodes, it may be necessary to add alkaline salts such as carbonates, phosphates or sulfites, in quantities from 5 to 30 g/l. They also act as regulators of the pH.

The electrolytic baths which form the object of the present invention are preferably used at a pH from 8 to 11, with a current density of 0.6 to 2.5 A/dm$^2$and at a temperature from 40° to 75° C.

The invention will be best understood with the aid of the following examples:

EXAMPLE 1

Gold, in the form of $KAu(CN)_2$: 4.0 g/l;
Copper, in the form of $K_2Cu(CN)_3$: 35.0 g/l;
Cadmium, in the form of $K_2$ $Cd(CN)_4$: 0.75 g/l;
Zinc, in the form of $K_2$ $Zn(CN)_4$: 10.0 g/l;
N,N-bis(carboxymethyl)aspartic acid sodium salt: 50.0 g/l;
KCN total (analyzed): 41.0 g/l;
9% N,N-dimethyloctadecylamine N-oxide wetting agent: 4.0 ml/l;
pH: 10.0.

A steel sheet was subjected to electrolysis in this bath at a current density of 0.8 A/dm$^2$and at the temperature of 60° C. The deposited alloy had the following composition:

Gold: 77%;
Copper: 12.7%;
Cadmium: 9.9%;
Zinc: 0.4%;

The deposit is uniform, brilliant, and of a pale yellow color 1 N 14.

EXAMPLE 2

Gold, in the form of $KAu(CN)_2$: 4.0 g/l;
Copper, in the form of $K_2Cu(CN)_3$: 37.5 g/l;
Cadmium, in the form of $K_2Cd(CN)_4$: 0.7 g/l;
Zinc, in the form of $K_2Zn(CN)_2$: 10 g/l;
Free KCN: 1.0 g/l;
Total KCN (analyzed): 42.0 g/l;
N-carboxymethyl aspartic acid sodium salt: 47 g/l;
Decyldimethylamine oxide wetting agent at 9%: 5 ml/l;
Organic brightener: condensation product of nicotinic acid and benzyl chloride at 50%: 2 ml/l.
pH 10.0.

A steel sheet was subjected to electrolysis in this bath at a current density of 1 A/dm$^2$ and at the temperature of 60° C. The alloy deposited had the following composition:

Gold: 74%;
Cadmium: 9.5%;
Copper: 16%;
Zinc: 0.5%

The deposit is uniform, brilliant, and of a pale yellow color 1 N 14.

For the gold baths depositing a ternary alloy, the speed of deposition is regulated, on the one hand by the permitted current density, and on the other hand by the quantity of organic complexing agent added to the bath. At low current density, the copper is slightly deposited with respect to the gold and the cadmium and the alloy is yellow. At high current density, there is an excess of copper which must be avoided by regulating the free cyanide concentration and by maintaining the organic complexing agent at relatively low concentrations.

It has been determined that the baths for quarternary alloys, which form the object of the present invention, permit a greater variation of current densities than the known baths for ternary alloys. They permit, in particular obtaining excellent deposits at high current densities, allowing a deposition speed of one micron in 1 to 2 minutes, which is much better than that of the generally-used baths, which require at least 3 minutes to deposit one micron.

They similarly provide excellent deposits at current densities weaker than those permitted for the baths of the trade. During "bulk" plating (using a bin), the deposit is made about two times more quickly than with the known baths, and with a more uniform distribution of color.

On the other hand, the known baths for ternary alloys permit, for deposits, a gold content of 14 to 18 carats, say from 58 to 75% gold. Outside of these limits, the deposits have neither a good appearance, nor good mechanical characteristics nor good corrosion resistance. The baths for quaternary alloys according to the invention containing zinc, functioning in the presence or in the absence of free cyanide, permit, a greater variation in the composition of the alloys deposited, the gold content of which may be comprised between 10 and 22 carats, say between 41 and 92% gold. In any case, the presence of zinc does not embrittle the deposit, which retains, within these limits, a good appearance and a high resistance to corrosion, as well as a good ductility.

The following examples illustrate other possibilities for deposition of gold-copper-cadmium-zinc alloys, starting from baths with different compositions with respect to the content of the constituents.

EXAMPLE 3

Five galvanic baths, B1 to B5, having the compositions set forth in Table 1 infra, were prepared.

The analysis of the total cyanide was effected as follows: 1 ml of the bath was withdrawn and diluted to 150 ml with demineralized water; then 25 ml of 25% NaOH and 5 ml of 5% KI were added and the titration was effected by means of a 0.1 N $AgNO_3$ solution until slight cloudy turbidity.

TABLE I

| | Composition of the Baths | | | | |
|---|---|---|---|---|---|
| Constituents | B1 g/l | B2 g/l | B3 g/l | B4 g/l | B5 g/l |
| Gold, in the form of KAu (CN))$_2$ | 1.0 | 4.0 | 4.0 | 4.0 | 4.0 |
| Copper, in the form of $K_2Cu(CN)_3$ | 35.0 | 35.0 | 35.0 | 35.0 | 35.0 |
| Cadium, in the form of $K_2Cd(CN)_4$ | 0.8 | 0.8 | 0.8 | 0.8 | 0.8 |
| Zinc, in the form of $K_2Zn(CN)_4$ | 10.0 | 20.0 | 10.0 | 5.0 | 10.0 |
| Free KCN | 5.0 | 5.0 | 5.0 | 5.0 | 5.0 |

TABLE I-continued

| Constituents | Composition of the Baths B1 g/l | B2 g/l | B3 g/l | B4 g/l | B5 g/l |
|---|---|---|---|---|---|
| Total KCN (analyzed) | 45.0 | 85.0 | 45.0 | 25.0 | 52.0 |
| Sodium hydroxyethylimino-diacetate | 55.0 | 100.0 | 50.0 | 35.0 | 50.0 |
| Wetting agent (amido-propyl-dimethyl amino-oxide of aliphatic acid of 11-17 carbon atoms), 9% solution (in ml/l) | 2.0 | 3.0 | 2.0 | 2.0 | 2.0 |
| Inorganic brighteners: | | | | | |
| sodium selenite (mg/l) | | | 0.02 | 0.01 | |
| sodium arsenite (mg/l) | | | 0.75 | | |
| zirconium (in the form of the sodium hydroxy-ethylimino-diacetate salt thereof) (mg/l) | | 0.05 | | 0.01 | 0.05 |
| potassium vanadate (mg/l) | | 1.0 | | | |
| Depolarizing agent (potassium thiomalate) (mg/l) | | | 2.0 | 3.0 | 5.0 |

The pH of these baths was 10.5, except for bath B1 which is least alkaline (10.0).

Next the baths B1 to B5 were used to obtain Au-Cu-Cd-Zn alloy deposits, working at a temperature of 60° C. and with a current density of 0.7 A/dm$^2$ for the baths B1 and B2, 0.8 A/dm$^2$ for bath B3, and 0.75 A/dm$^2$ for bath B4. The bath B5 was used with a current density of 1.0 A/dm$^2$ (B5a), then with 1.25 A/dm$^2$ (B5b).

The results obtained are mentioned in Table II below:

TABLE II

| Alloys | Bath | Composition (wt. %) Au | Cu | Cd | Zn | Decomposition Speed (min/micron) |
|---|---|---|---|---|---|---|
| A1 | B1 | 75.0 | 15.3 | 9.5 | 0.2 | — |
| A2 | B2 | 72.5 | 18.0 | 9.0 | 0.5 | — |
| A3 | B3 | 72.5 | 18.1 | 9.1 | 0.3 | 2 |
| A4 | B4 | 78.0 | 13.5 | 8.3 | 0.2 | — |
| A5 | B5a | 73.4 | 18.0 | 8.1 | 0.5 | 2 |
| A6 | B5b | 67.6 | 24.4 | 7.6 | 0.4 | 1.6 |

The deposits obtained are all of a pale yellow hue, ductile, brilliant and perfectly resistant to corrosion. There are obtained, for example, hues that are approximately of the color type normalized 1 N 14, although in the same conditions, the Au-Cu-Cd ternary alloys are more yellow (approximately color normalized 2 N 18). Not any change of color, nor any corrosion were observed on the tested specimens during six days of tests with synthetic sweating (according to LSRH) and with thioacetamide.

It may moreover be verified that in causing the total cyanide concentration to vary in the galvanic bath by means of zinc, there is obtained only a slight change in percentage of the different metals, which is not the case with the known baths.

Moreover, the measurements effected in the case of the alloys A 5 and A 6 demonstrate an efficiency in mg/A.min respectively of 73.0 and 67.4, which is clearly superior to the efficiency normally obtained with known baths and which does not exceed 55 mg/A.min.

Finally, Vickers hardness measurements effected on the alloys A 5 and A 6 are given as results, respectively 425 and 350, which is superior to the Au-Cu-Cd ternary alloys obtained with the baths of the prior art (about 300 at most) and which proves that the alloys according to the invention have a better resistance to wear.

I claim:

1. Galvanic bath for the electroytic deposit of gold-copper-cadmium-zinc alloys, characterized by the fact that it contains a cyanide complex of gold, a cyanide complex of copper, a cyanide complex of cadmium, and a cyanide complex of zinc, and at least one complexing agent and one surface-active agent.

2. Bath according to claim 1 characterized by the fact that it contains in addition a depolarizing agent and/or an organic or inorganic brightener.

3. Bath according to claim 2, characterized in that the depolarizing agent is selected from mercaptosuccinic acid, sodium thiosulphonate, and the derivatives of thiocarboxylic acids or thioalkanesulphonic acids.

4. Bath according to claim 2, characterized in that the inorganic brightener is chosen from the soluble salts or the complexes of selenium, tellurium, vanadium, arsenic, antimony, thallium, bismuth, titanium, germanium, zirconium, tantalum and niobium or a mixture thereof.

5. Bath according to claim 2, characterized in that organic brightener is selected from the group consisting of condensation products of: nicotinic acid and benzyl chloride; benzylpyridine-carboxylate and piperonyl bisulphite; benzylpyridine carboxylate and anisaldehyde bisulphite; and benzylpyridine carboxylate, piperonyl bisulphite and anisaldehyde bisulphite.

6. Bath according to claim 1, characterized in that each said at least one complexing agent is selected from the group consisting of: aminocarboxylic acid and phosphonate.

7. Bath according to claim 6, wherein said aminocarboxylic acid is selected from the group consisting of hydroxyalkylamino carboxylic acid and polyaminocarboxylic acid.

8. Bath according to claim 6, wherein said phosphonate is selected from the group consisting of amino-tris-(methylenephosphonic) acid, 1-hydroxyethylidine-1, 1-diphosphonic acid, ethylene-diamine-tetra (methylene-phosphonic) acid, and hexamethylene-diamine-tetra (methylenephosphonic) acid.

9. Bath according to claim 1, characterized in that said complexing agent is an alkaline salt of a member selected from the group consisting of: hydroxyethylaminodiacetic acid, oxycarbonyl-ethylaminodiacetic acid, nitrilo-tri-acetic acid, imino-diacetic acid, N-carboxy-methyl-aspartic acid and glutamic acid.

10. Bath according to claim 1, characterized in that the surface-active agent is chosen from the group consisting of amidopropyldimethylamino oxides of saturated aliphatic acids, dimethylalkylamino oxides of saturated aliphatic acids, bis-(2-hydroxyethyl)-alkyl amino oxides of saturated aliphatic acids, having a carbon chain containing from 11 to 20 carbon atoms, and phosphorated esters of ethylene oxide chains connected to an aliphatic chain of 8 to 18 carbons.

11. Bath according to claim 1 characterized in that it contains from 0.5 to 20 g/l gold, from 5 to 70 g/l copper, from 0.1 to 5 g/l cadmium, from 0.5 to 50 g/l zinc, from 0 to 30 g/l free potassium cyanide, from 1 to 200 g/l total cyanide, from 5 to 200 g/l complexing agent, from 0.01 to 50 ml/l wetting agent, from 0.01 to 100 mg/l inorganic brightener, from 1 to 5 ml/l of organic brightener, and from 2 to 200 mg/l of depolarizing agent.

12. Bath according to claim 1, devoid of free cyanide.

13. Bath according to claim 1, containing free cyanide.

14. Method of coating an article with an electrolytic deposit of gold-copper-cadmium-zinc alloys, comprising the steps of:

providing a galvanic bath containing as constituents: a cyanide complex of gold, a cyanide complex of copper, a cyanide complex of cadmium, a cyanide complex of zinc, and at least one complexing agent and one surface-active agent;

immersing said article in said bath;

adjusting the amount of the said constituents of said bath such that passage of electric current through said bath produces on said article a cathodic alloy deposit of gold from 10 to 22 carats; and passing an electric current through said bath in an amount sufficient to deposit on said article an alloy layer having a gold content from 10 to 22 carats.

15. Method of coating an article with an electrolytic deposit of gold-copper-cadmium-zinc alloys, comprising the steps of:

providing a galvanic bath containing as constituents: a cyanide complex of gold, a cyanide complex of copper, a cyanide complex of cadmium, a cyanide complex of zinc, and at least one complexing agent and one surface-active agent; such that said bath contains from 0.5 to 20 g/l gold, from 5 to 70 g/l copper, from 0.1 to 5 g/l cadmium, from 0.5 to 50 g/l zinc, from 0 to 30 g/l free potassium cyanide, from 1 to 200 g/l total cyanide, from 5 to 200 g/l complexing agent, from 0.01 to 50 ml/l wetting agent, from 0.01 to 100 mg/l inorganic brightener, from 1 to 5 ml/l of organic brightener, and from 2 to 200 mg/l of depolarizing agent;

immersing said article in said bath;

adjusting the amount of the said constituents of said bath such that the pH of said bath is comprised between 8 and 11; and passing an electric current through said bath in an amount sufficient to deposit on said article an alloy layer having a gold content from 10 to 22 carats.

16. An article coated with an electrolytically deposited coating produced by the method of claim 14.

* * * * *